US006942515B1

(12) United States Patent
Wu

(10) Patent No.: US 6,942,515 B1
(45) Date of Patent: Sep. 13, 2005

(54) CONNECTOR

(76) Inventor: Yung-Yu Wu, c/o PMB#1008, 1867 Ygnacio Vally Rd., Walnut Creek, CA (US) 94598

( * ) Notice: Subject to any disclaimer, the term of this patent is extended or adjusted under 35 U.S.C. 154(b) by 46 days.

(21) Appl. No.: 10/986,917

(22) Filed: Nov. 15, 2004

(51) Int. Cl.[7] ..... H01R 13/62
(52) U.S. Cl. ..... 439/331
(58) Field of Search ..... 439/326, 331, 439/630, 736, 722, 862, 260

(56) References Cited

U.S. PATENT DOCUMENTS 5,733,147 A * 3/1998 Verstijnen ..... 439/630
6,120,328 A * 9/2000 Bricaud et al. ..... 439/630
6,305,948 B1 * 10/2001 Wu ..... 439/66

* cited by examiner

*Primary Examiner*—Tho D. Ta
(74) *Attorney, Agent, or Firm*—Leong C. Lei

(57) ABSTRACT

A connector for power or data transmission includes terminals arranged at front and rear sides of a main body thereof. Each of the terminals has a middle portion embedded in an injection-molded plastic material of the main body, a conducting head slightly upward exposed from the main body, and a soldering tail flatly attached to a bottom of the main body. The conducting head and the soldering tail are axially offset from the middle portion in two opposite directions, so that conducting heads of terminals at the front or rear side of the main body and soldering tails extended from terminals at the other side alternate at each side of the main body. A cover is turnably closed to a top of the main body to press and electrically connect an inserted card to the conducting heads of the connector.

2 Claims, 4 Drawing Sheets

CONNECTOR

BACKGROUND OF THE INVENTION (a) Technical Field of the Invention

The present invention relates to a connector, and more particularly to a connector having terminals arranged in a special way to provide coplanar conducting heads and soldering tails as well as highly positional and electrical stability, avoid high-frequency electromagnetic wave interference, and enable low assembling cost.

(b) Description of the Prior Art

While connector sockets have been largely miniaturized, they have not had many structural improvements or changes over past years. Connectors play very important roles in many popular electronic products, such as mobile phones, digital cameras, notebook computers, personal digital assistants (PDA). Different connectors might have different positional and electrical stability as well as different durability due to different designs thereof, however, they all have to meet the requirements of being compact, miniaturized, easily plugged and unplugged, stable, solid, and durable.

Most of the currently available connectors have internal terminals with projected and exposed soldering legs separately located in individual recesses. The soldering of the projected terminal legs takes time, and the soldered terminal legs do not always provide coplanar contact surfaces. The following are some common problems with the currently available connectors.

Since the terminals are located in and projected from their respective recesses, they are not well protected from easy separation and deformation, and tend to have broken legs under externally applied force. All these factors result in very high wear and damage rates of the connector.

Since the terminals before soldering are not always coplanar, the connector soldered to a motherboard via the non-coplanar terminals tends to bias, which inevitably results in secondary processing and increased manufacturing cost of the connector to lower its competing ability in the market.

The projected terminal legs form a weakened portion of the connector and are subjected to breaking or deformation under external force. The broken or deformed terminal legs result in a non-conductive connector or shorten the usable life of the connector.

It takes additional time and labor and requires high precision machinery to solder the projected terminal legs. Moreover, the projected terminal legs are not protected against interference in electric signals.

To solve the above-mentioned problems, another type of connector with terminals embedded in a plastic material thereof has been developed, so that the terminals are firmly connected to the connector without the risk of easily becoming separated, deformed, or broken, and are not necessarily located in individual recesses in a precise manner. However, this new type of connector does not really solve the problems existed in the conventional connectors. That is, the projected and exposed soldering legs of the terminals are still not always coplanar, and the increased costs for quality control, inspection, and secondary processing of the connector still exist.

It is therefore tried by the inventor to develop a connector with specially designed and arranged terminals, so that soldering tails of the terminals soldered to a motherboard are not exposed or projected from the connector, and the problem of high-frequency electromagnetic wave interference is prevented.

SUMMARY OF THE INVENTION

A primary object of the present invention is to provide a connector having terminals that are embedded in a plastic material of the connector, have concealed soldering tails, and are arranged in a special way to provide highly positional and electrical stability, so that the connector could avoid high-frequency magnetic wave interference, and be manufactured at lowered cost.

To achieve the above and other objects, the connector of the present invention includes a plurality of terminals arranged at front and rear sides of a main body of the connector. Each of the terminals has a middle portion embedded in an injection-molded material of the main body, a conducting head located in and slightly upward projected from an individual opening on the main body, and a soldering tail flatly attached to a bottom of the main body with a free end of the soldering tail flushed with the front or rear side of the main body. The conducting head and the soldering tail are axially offset from the middle portion in two opposite directions, so that conducting heads of terminals at one of the front and rear sides of the main body and soldering tails extended from terminals at the other side alternate at each front or rear side of the main body. A cover is pivotally turnably connected to a top of the main body to press and electrically connect an inserted card to the conducting heads of the connector.

With the middle portion of the terminals embedded in the injection-molded plastic material of the main body, the connector has a strengthened structure without the risk of easily becoming deformed, bent, or warped. And, with the soldering tails partially embedded in the plastic material of the main body and free ends of the soldering tails flatly attached to the bottom of the main body and flushed with front and rear sides of the main body, the soldering tails soldered to the motherboard are completely concealed below the connector. In this manner, the problems of non-coplanar terminals and a bias connector soldered to a motherboard via such non-coplanar terminals could be solved.

Furthermore, with the conducting head and the soldering tail axially offset from the middle portion of each terminal, and the conducting heads of terminals at one side and the soldering tails extended from terminals at the opposite side alternating at each of the front and the rear side of the main body of the connector, the miniaturized connector has not only enhanced bending strength and deformation strength, but also terminals that are effectively spaced at both the conducting heads and the soldering tails to minimize possible errors in soldering the terminals.

In summary, the connector of the present invention has the following three structural features:

Concealed and non-projected terminals: After the connector is soldered to, for example, the motherboard of a computer, all the soldering tails of the terminals of the connector are completely concealed below the main body of the connector to eliminate the problems of secondary processing and broken soldering tails, and the whole connector could locate in a horizontal plane without biasing. And, all the conducting heads of the terminals are separately located in individual openings to slightly upward project therefrom and be elastically depressed by the cover to electrically contact with the card inserted into the connector. Therefore, all the spaced terminals are well protected against deformation by external force, and the power card or data card could be easily and horizontally inserted into the connector and pressed against the terminals by the cover without the need of being in surface contact with the terminals.

Terminals embedded in injection-molded plastic material of the connector: When the connector is located in place via an automated machine and then injection-molded with the plastic material, the terminals are separately, orderly, and uniformly embedded in the injection-molded plastic material to locate in the same horizontal plane with the conducting heads and the soldering tails exposed from the plastic material. Therefore, problems in connection with the provision of separate and precise recesses for locating the terminals in place are avoided. Moreover, the terminals may have specific elastic stress and size of soldering point determined by a length of the conducting heads and of the soldering tails exposed from the injection-molded plastic material, and could therefore be used for various types of connectors having different sizes. The spaced terminals partially embedded in the injection-molded plastic material are adapted to produce equal and uniform elastic stress when the pivotally turnable cover of the connector is closed to the top of the main body, and enhanced contact stress in contacting with the main body of the connector. All these factors enable the connector of the present invention to have prolonged usable life.

Alternate conducting heads and soldering tails of terminals at each of two opposite sides of the main body of the connector: The alternate conducting heads and soldering tails of terminals at two opposite sides of the main body not only enable a structurally strengthened connector with increased compression strength and bending strength, but also eliminate problems in connection with projected soldering legs existed in the conventional connectors. Therefore, the connector of the present invention could be smoothly and stably soldered to a desired place with the soldering tails flatly attached to and completely concealed below the connector.

With the above-mentioned features, the connector of the present invention has highly positional and electrical stability as well as coplanar terminals to avoid high-frequency magnetic wave interference and high assembling cost.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
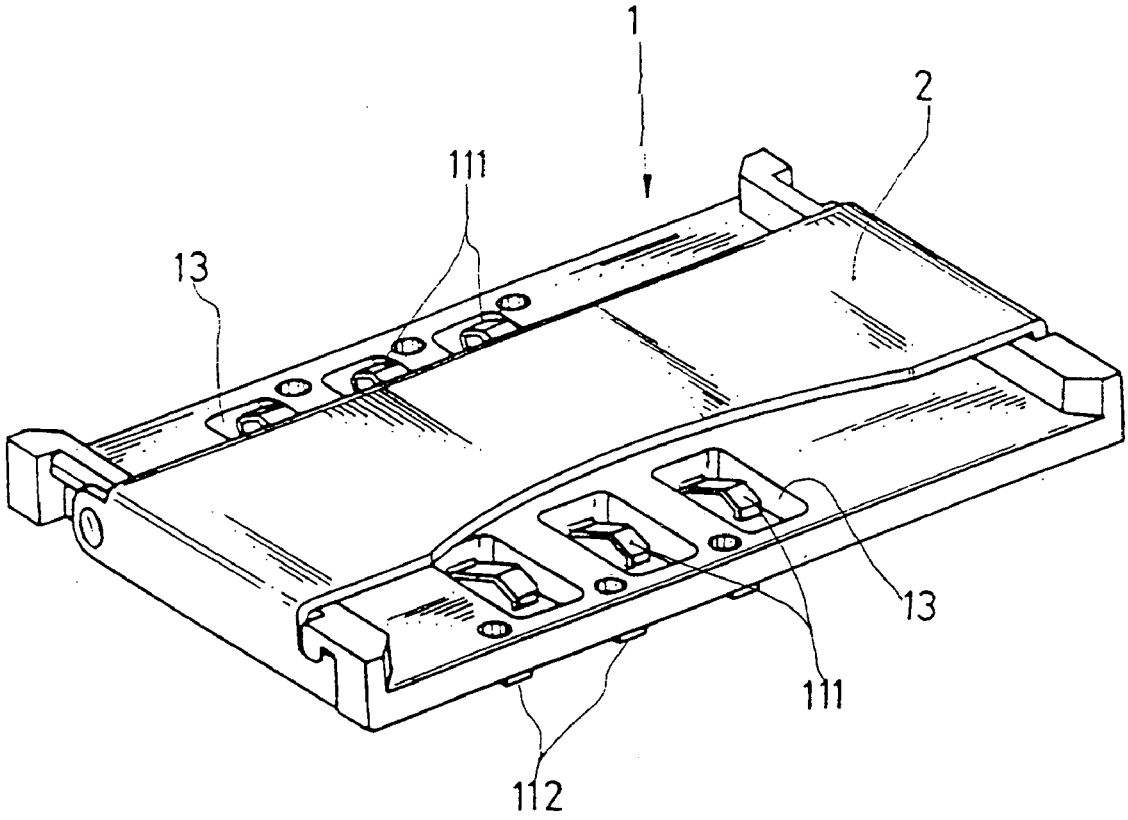
FIG. 1 is a top perspective view of a connector according to a preferred embodiment of the present invention.

Please refer to FIG. 1, which is a top perspective view of a connector according to a preferred embodiment of the present invention for mounting on, for example, a motherboard to enable power or data transmission. As shown, the connector of the present invention mainly includes a main body 1 and a cover 2 connected to a top of the main body 1 to shield part of the main body 1. The main body 1 is in the form of a framed slot for a power card or a data card to insert thereinto. The cover 2 could be pivotally lifted from the top of the main body 1. When the cover 2 is closed to the main body 1, it applies a pressure to the power card or the data card inserted in the main body 1, so that the power or the data card is electrically connected to terminals 11 in the main body 1.

Figure 2:
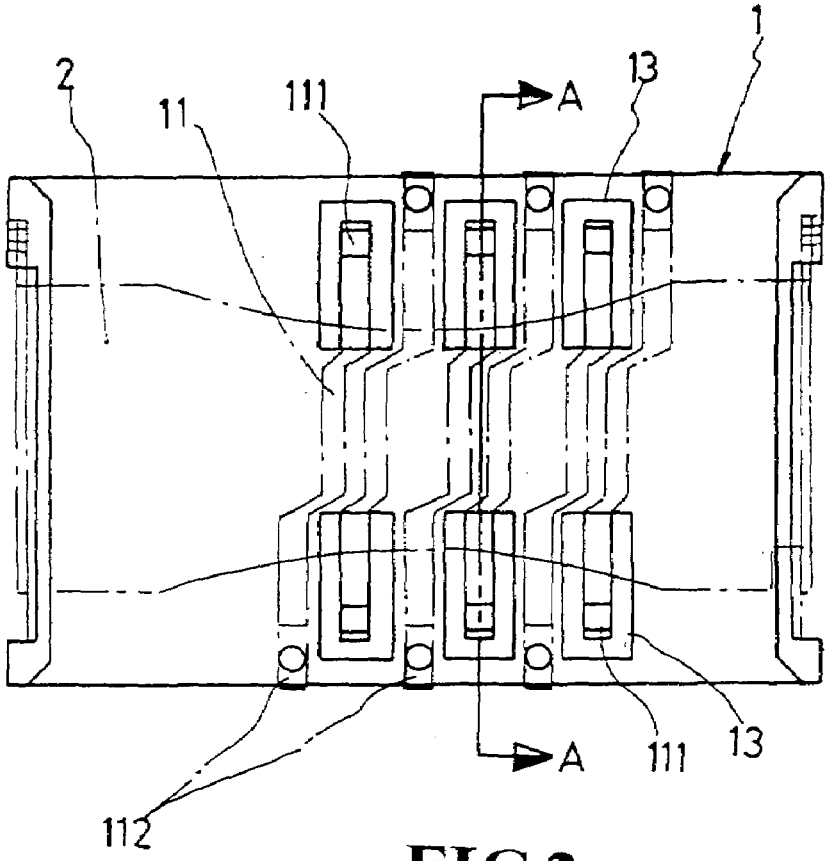
FIG. 2 is a top phantom view of the connector of FIG. 1 showing an internal structure of a main body of the connector.
Figure 3:
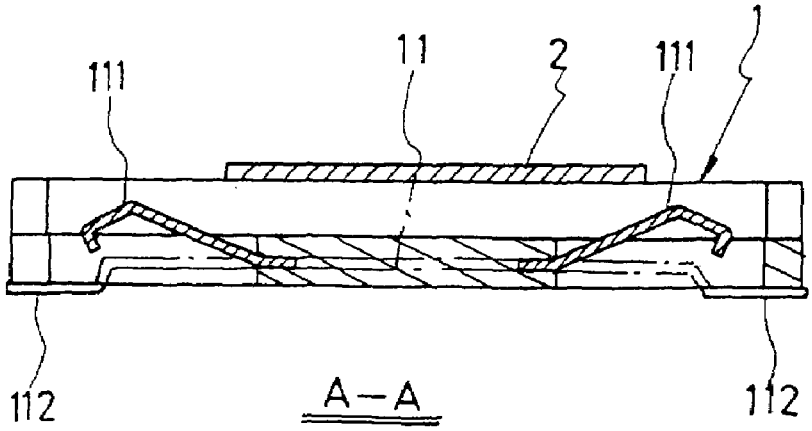
FIG. 3 is a sectional view taken along line A—A of FIG. 2.
Figure 6:
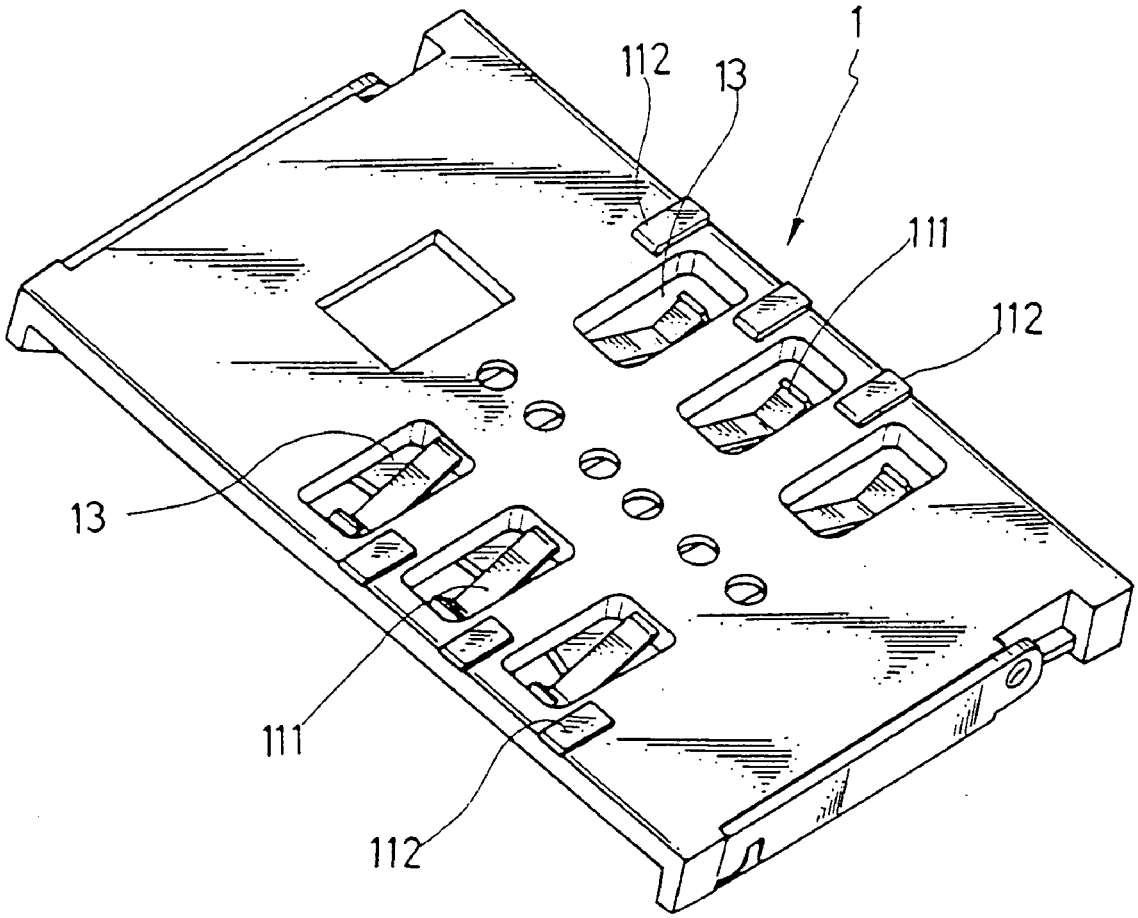
FIG. 6 is a bottom perspective view of the connector of FIG. 1.

Please refer to FIG. 2. The terminals 11 in the main body 1 are oppositely disposed at front and rear sides of the main body 1, such that conducting heads 111 of the terminals 11 at one side and soldering tails 112 extended from the terminals 11 at the other side alternate at each side. The terminals 11 are embedded in the main body 1 when the latter is injection molded with a plastic material, so that a middle portion of every terminal 11 is completely embedded in the plastic material while the conducting heads 111 and the soldering tails 112 are exposed from the main body 1. Please refer to FIG. 6, which is a bottom perspective view of the connector of the present invention. The soldering tail 112 is a bent and horizontally extended rear end of the terminal 11. All the soldering tails 112 of the terminals 11 are initially exposed from and flatly attached to a bottom of the main body 1, and then soldered to the main body 1 using surface mount technology (SMT) equipment, so that the soldering tails 112 on a finished connector of the present invention are completely concealed at the bottom of the main body 1 without any exposed soldering legs or soldering contacts.

Figure 4:
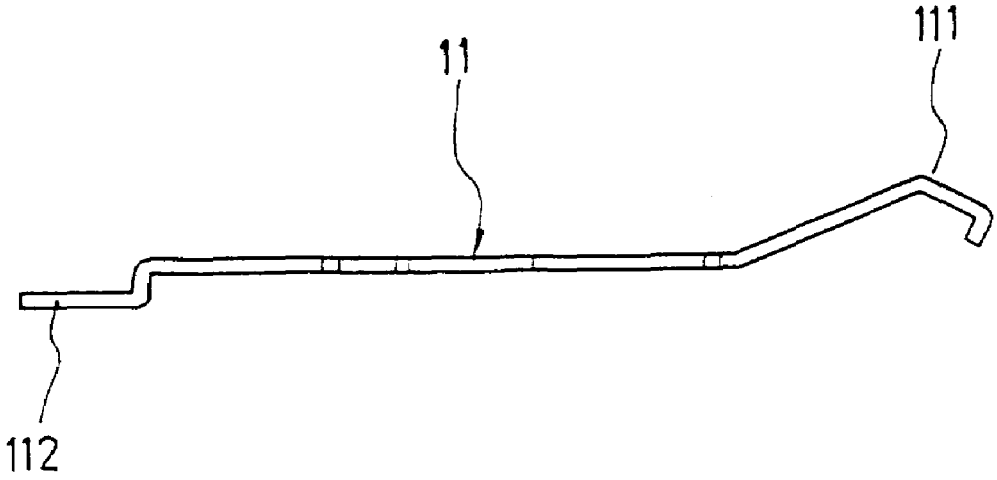
FIG. 4 is a front view of a terminal in the connector of FIG. 1.
Figure 5:
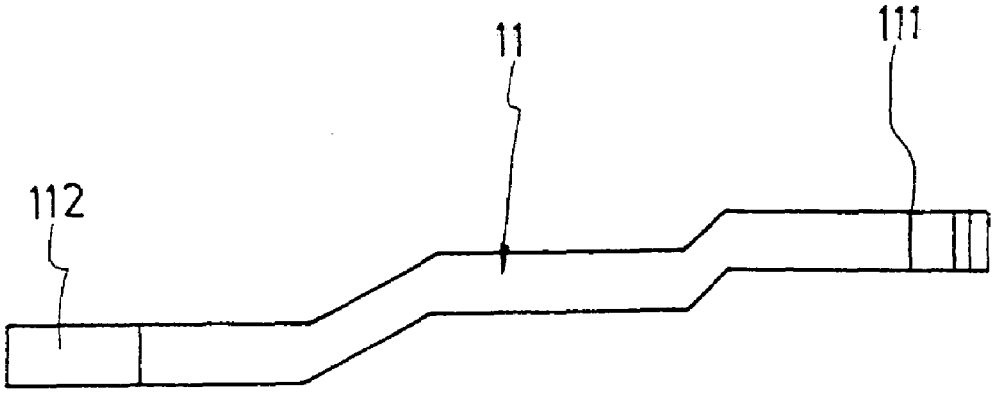
FIG. 5 is a top plan view of the terminal of FIG. 4.

FIGS. 4 and 5 are front and top plan views, respectively, of the terminal 11 of the present invention. As can be seen from FIG. 4, the terminal 11 includes a front portion that is forward and upward extended from the middle portion of the terminal 11 and then downward bent near a front end to form a hook-like conducting head 111, and a rear portion that is rearward and horizontally extended from the middle portion of the terminal 11 and then downward bent near a rear end to form a horizontal soldering tail 112. And, as can be seen from FIG. 5, front and rear ends of the middle portion of the terminal 11 are sideward extended in two opposite directions, so that the conducting head 111 and the soldering tail 112 respectively forward and rearward extended from of the middle portion are axially offset from the middle portion.

Please refer to FIGS. 1, 2, 3 and 6 for the arrangement of the terminals 11 on the main body 1. As shown, the front portion of each terminal 11 is upward projected from the injection-molded plastic material of the main body 1 to locate in and exposed from an individual opening 13 with a top of the bent conducting head 111 slightly higher than a horizontal plane passing a top of the opening 13, so that the conducting head 111 could be elastically depressed by the cover 2 to electrically contact with a card inserted into the connector of the present invention. On the other hand, the soldering tail 112 of each terminal 11 is downward projected from the injection-molded plastic material of the main body 1 to flatly locate at the bottom of the main body 1 offset from the middle portion and opposite to the conducting head 111 with a free end of the soldering tail 112 flushed with front or rear side of the main body 1.

When the main body 1 of the connector of the present invention is soldered to a motherboard of a computer, all the soldering tails 112 are completely concealed below the main body 1, and all soldered points at the soldering tails 112 are coplanar to provide the connector with highly positional and electrical stability. The problems of poor soldering, broken soldering legs, and non-coplanar conducting legs, as well as high manufacturing and/or processing cost resulted from the non-planar conducting legs are therefore overcome.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A connector comprising a main body and a cover pivotally turnably connected to a top of said main body;

said main body being in the form of a framed slot, and having a plurality of terminals embedded therein when said main body is injection-molded with a plastic material; each of said terminals including a conducting head and a soldering tail that are axially offset from a middle portion of said terminal in two opposite directions and exposed from said injection-molded plastic material of said main body to respectively locate in an individual opening on said main body and conceal below said main body; said terminals being arranged at front and rear sides of said main body in such a manner that said conducting heads of said terminals at one of the front and rear sides of said main body and said soldering tails extended from said terminals at the other side alternate at each side of said main body; a top of said conducting head being slightly higher than a plane passing a top of said opening to allow elastic contact with an inserted card and depression by said cover closed to the top of said main body; and said soldering tail being flatly attached to a bottom of said main body and having a free end flushed with front or rear sides of said main body.

2. The connector as claimed in claim 1, wherein said conducting heads and said soldering tails of said terminals have a length that could be differently determined to effectively provide said terminals with different elastic stress and different sizes of soldering points at said terminals, enabling said terminals to use on differently sized and shaped connectors.

* * * * *